US006351204B1

(12) United States Patent
Yamasawa et al.

(10) Patent No.: US 6,351,204 B1
(45) Date of Patent: Feb. 26, 2002

(54) THIN MAGNETIC ELEMENT AND TRANSFORMER

(75) Inventors: Kiyohito Yamasawa, Nagano-ken; Yasuo Hayakawa, Niigata-ken; Takashi Hatanai, Niigata-ken; Akihiro Makino, Niigata-ken; Yutaka Naito, Niigata-ken; Naoya Hasegawa, Niigata-ken, all of (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/565,285

(22) Filed: May 2, 2000

Related U.S. Application Data

(63) Continuation of application No. 08/904,058, filed on Jul. 31, 1997, now Pat. No. 6,140,902.

(30) Foreign Application Priority Data

Aug. 8, 1996 (JP) ..... 8-210308

(51) Int. Cl.[7] ..... H01F 5/00
(52) U.S. Cl. ..... 336/200; 336/223; 336/232
(58) Field of Search ..... 336/200, 223, 336/232, 83; 148/304, 306; 428/692, 900, 611, 328, 332

(56) References Cited

U.S. PATENT DOCUMENTS 4,313,152 A * 1/1982 Vranken ..... 361/765
5,572,179 A * 11/1996 Ito et al. ..... 336/200
5,583,474 A 12/1996 Mizoguchi et al.
5,750,273 A * 5/1998 Inoue et al. ..... 428/692

FOREIGN PATENT DOCUMENTS

JP 57066523 4/1982

OTHER PUBLICATIONS

Goldberg et al., IEE Transactions on Power Electronics, vol. 4, No. 1, Jan. 1989, Issues Related to 1–10–MHz Transformer Design.

* cited by examiner

*Primary Examiner*—Anh Mai
(74) *Attorney, Agent, or Firm*—Brinks Hofer Gilson & Lione

(57) ABSTRACT

A thin magnetic element comprising a coil pattern formed on at least one side of a substrate and a thin magnetic film formed on the coil pattern, wherein, assuming that the thickness and width of a coil conductor constituting the coil pattern are t and a, respectively, an aspect ratio t/a of the coil conductor satisfies the relationship $0.035 \leqq t/a \leqq 0.35$, and the thin magnetic film has a resistivity of 400 $\mu\Omega$cm or more.

4 Claims, 5 Drawing Sheets

THIN MAGNETIC ELEMENT AND TRANSFORMER

This application is a continuation of Ser. No. 08/904,058 filed Jul. 31, 1997 U.S. Pat. No. 6.140,902.

BACKGROUND OF THE INVENTION

1. Field of the Invention

This invention relates to a thin magnetic element comprising a coil pattern formed on a substrate and a thin magnetic film formed on the coil pattern; and a transformer equipped with the element.

2. Description of the Related Art

Reflecting the size reduction and performance improvement of a magnetic element, a soft magnetic material is required to have a high magnetic permeability at a frequency not lower than several hundreds MHz, particularly, to have a high saturation magnetic flux density of 5 kG or higher and at the same, high specific resistance and low coercive force. In a transducer, among various applications, a soft magnetic material having a high specific resistance is especially requested.

As magnetic materials having a high saturation magnetic flux density, Fe and a number of and alloys composed mainly of Fe are known. When manufactured using such an alloy by the film forming technique such as sputtering method, the thin magnetic film so obtained has a high coercive force and small specific resistance in spite of a high saturation magnetic flux density and it is difficult to obtain good soft magnetic properties in a high frequency region. In addition, ferrite frequently employed as a bulk material does not provide excellent soft magnetic properties when formed into a thin film.

As one of the causes for the reduction of a magnetic permeability at high frequency is a loss caused by the generation of an eddy current. For the prevention of such an eddy current loss which is one of the causes for the reduction the magnetic permeability at high frequency, there is accordingly a demand for a reduction in the film thickness and an increase in the resistance of a thin film.

It is however very difficult to heighten the specific resistance while maintaining the magnetic properties. A soft thin magnetic film formed of a crystal alloy, for example, Sendust or an amorphous alloy has a specific resistance as small as several tens $\mu$Q·cm. There is accordingly a demand for soft magnetic alloys having an increased specific resistance with a saturation magnetic flux density being maintained at 5 kG (0.5 T) or greater.

When a soft magnetic alloy is formed into a thin film, it becomes more difficult to obtain good soft magnetic properties owing to an influence of the generation of magneto striction, or the like.

Particularly in the case where a thin magnetic element is formed by disposing a thin film of a soft magnetic alloy close to a coil, it is still more difficult to obtain a high inductance and figure of merit while maintaining good soft magnetic properties which the soft magnetic alloy originally has possessed and also to control a temperature rise during use. In the conventional thin magnetic element of such a type, a loss increase occurs in the thin film formed of a soft magnetic alloy prior to the lowering in the figure of merit Q of a coil itself constituting a magnetic core, resulting in the tendency to limit the high-frequency properties which a transducer or reactor should have as a thin magnetic film. In other words, the application, as a thin magnetic film, of a Co-group amorphous thin film, a Ni-Fe alloy thin film or the like which has excellent soft magnetic properties can be considered but such a thin film does not have a high specific resistance and is apt to increase a loss at high frequency, whereby the high-frequency properties of the entire magnetic element tend to be limited.

SUMMARY OF THE INVENTION

With the forgoing in view, the present invention has been completed. An object of the present invention is to provide a thin magnetic element which can be reduced in its thickness, exhibits a high inductance and figure of merit Q, can meet the use at a high frequency region and does not emit heat so much; and also to provide a transformer equipped with the thin magnetic element.

With a view to overcoming the above-described problems, the present invention provides a thin magnetic element which comprises a coil pattern formed on one side or both sides of a substrate and a thin magnetic film formed on said coil pattern, said thin magnetic film being formed to a thickness of 0.5 $\mu$m or greater but 8 $\mu$m or smaller; and at least one of the following conditions is satisfied: assuming that the thickness and width of a coil conductor constituting a coil pattern are "t" and "a", respectively, an aspect ratio t/a of the coil conductor satisfies the relationship of $0.035 \leqq t/a \leqq 0.35$; and assuming that the width of the coil conductor constituting the coil pattern is a and the distance between the mutually adjacent coil conductors in the coil pattern is b, the relationship of $0.2 \leqq a/(a+b)$ is satisfied.

A good figure of merit Q can be attained by forming the thin magnetic film on the coil pattern to the above-described thickness; a temperature rise of the coil conductor can be suppressed by setting the aspect ratio of the coil conductor within the above-described range; and a stably high inductance, low equivalent resistance and good figure of merit Q can be achieved by satisfying the relationship of $0.2 \leqq a/(a+b)$.

In the above-described constitution, it is preferred that the thin magnetic film comprises a fine crystalline phase having an average grain size of 30 nm or smaller and being composed mainly of at least one element selected from the group consisting of Fe, Co and Ni, and an amorphous phase composed mainly of a compound consisting of at least one element M selected from the group consisting of lanthanoide type rare earth elements (at least one of La, Ce, Pr, Nd, Pm, Sm, Eu, Gd, Tb, Dy, Ho, Er, Tm and Lu), Ti, Zr, Hf, Ta, Nb, Mo and W, and O or N.

It is more preferred that the above-described thin magnetic film has a composition represented by the following composition formula:

$$A_aM_bM'_cL_d$$

wherein A represents at least one element selected from the group consisting of Fe, Co and Ni, M represents at least one element selected from the group consisting of lanthanoide type rare earth elements (at least one of La, Ce, Pr, Nd, Pm, Sm, Eu, Gd, Tb, Dy, Ho, Er, Tm and Lu) and Ti, Zr, Hf, V, Nb, Ta and W, M' represents at least one element selected from the group consisting of Al, Si, Cr, Pt, Ru, Rh, Pd and Ir; L represents at least one of the elements O and N; and a, b, c and d represent compounding ratios satisfying the relationships of $20 \leqq a \leqq 85$, $5 \leqq b \leqq 30$, $0 \leqq c \leqq 10$ and $15 \leqq d \leqq 55$, each in atomic %.

The use of a thin magnetic film having such a constitution or such compounding ratios makes it possible to increase the specific resistance of the thin magnetic film itself, reduces the loss in the high frequency region and decreases the limitations in the high frequency region which the conventional material has.

DETAILED DESCRIPTION OF THE PREFERRED EMBODIMENTS

The embodiments of the present invention will hereinafter be described with reference to the accompanying drawings.

Figure 1:
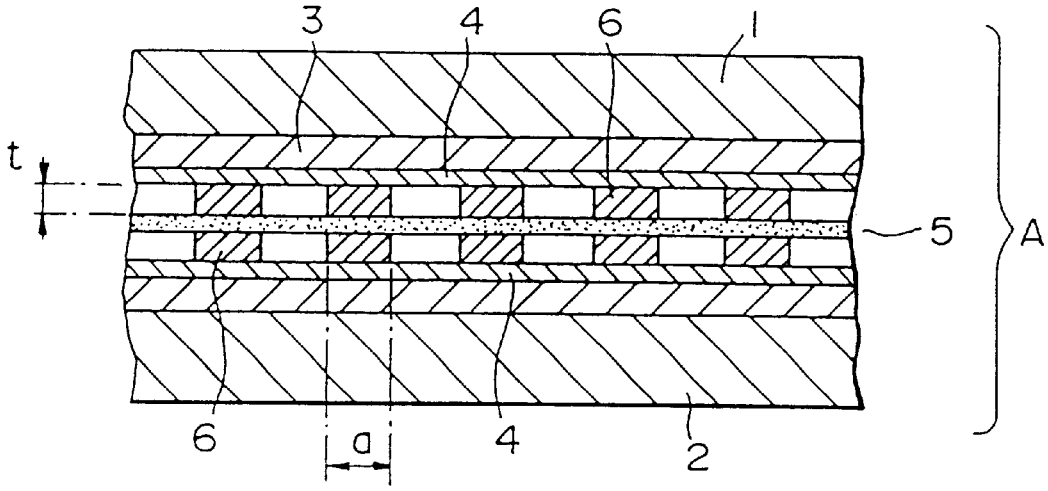
FIG. 1 is a cross-sectional view illustrating one embodiment of the thin magnetic element according to the present invention.
Figure 2:
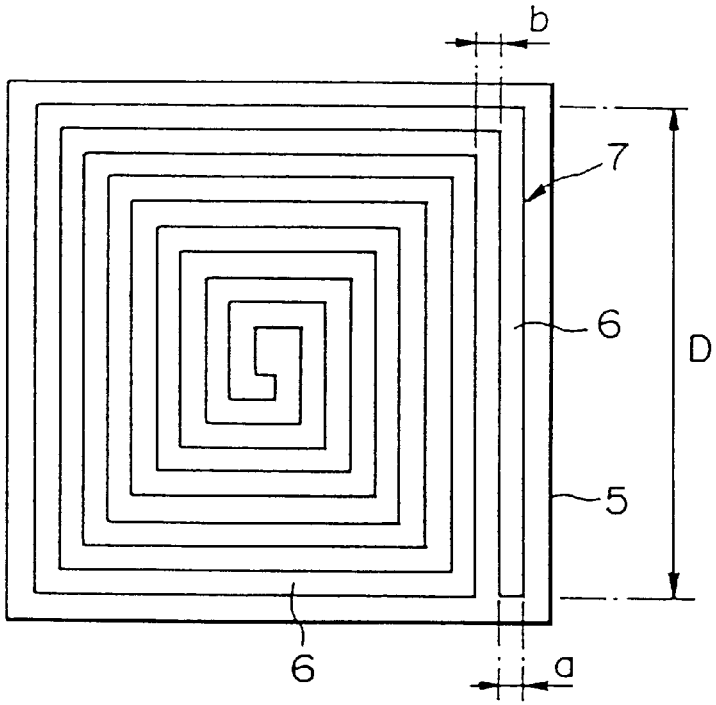
FIG. 2 is a plain view of the coil conductor which is disposed on the thin magnetic element illustrated in FIG. 1.

FIGS. 1 and 2 each illustrates the first embodiment of the present invention. A thin magnetic element A of this type is formed by stacking a thin magnetic film 3 and an insulation film 4 on the surfaces of substrates 1,2 opposite to each other and disposing coil conductors 6,6 with a flexible substrate 5, which has been arranged between the up-and-down insulation films 4,4, therebetween. FIG. 2 is a plane view of a coil 7 formed of the above-described coil conductor 6 and the coil conductor 6 in this embodiment is in a quadrate spiral shape. Incidentally, the coil conductor is not limited by that illustrated in FIG. 2 but any shape of meander and a combination of spiral and meander can be employed.

The substrates 1,2 are each formed of an insulating nonmagnetic material such as resin, for example, polyimide or ceramic.

The thin magnetic film 3 is formed of the below-described special soft magnetic material having a high specific resistance.

Assuming that A represents at least one element selected from the group consisting of Fe, Co and Ni, M represents at least one element selected from the group consisting of lanthanoide type rare earth elements (at least one of La, Ce, Pr, Nd, Pm, Sm, Eu, Gd, Tb, Dy, Ho, Er, Tm and Lu), Ti, Zr, Hf, V, Nb, Ta and W, M' represents at least one element selected from the group consisting of Al, Si, Cr, Pt, Ru, Rh, Pd and Ir; and L represents at least one element selected from O and N, the special soft magnetic material constituting the thin magnetic film 3 is represented by the following composition formula:

$$A_aM_bM'_cL_d$$

In the above composition formula, a, b, c and d which show the compounding ratios preferably satisfy the following relationships:

$20 \leqq a \leqq 85$, $5 \leqq b \leqq 30$, $0 \leqq c \leqq 10$ and $15 < d < 55$, each in atomic %. It is more preferred that the thin magnetic film has the above-described composition and is formed of a fine crystalline phase which is composed mainly of at least one element selected from the group consisting of Fe, Co and Ni and has an average grain size of 30 nm or smaller and an amorphous phase which is composed mainly of a compound consisting of elements M and O or a compound consisting of elements M and N.

Described specifically, when the thin magnetic film 3 is formed of a material having a composition represented by the following formula: $Fe_{eMf}O_g$ wherein M is the rare earth element, it is more preferred the compounding ratios, e, f and g, satisfy the following relationships: $50 \leqq e \leqq 70$, $5 \leqq f \leqq 30$ and $10 \leqq g \leqq 40$, each in atomic %.

When the thin magnetic film 3 is formed of a material having a composition represented by the following formula: $Fe_hM_iO_j$ wherein M is at least one element selected from the group consisting of Ti, Zr, Hf, V, Nb, Ta and W, it is more preferred that the compounding ratios, h, i and j, satisfy the following relationships: $45 \leqq h \leqq 70$, $5 \leqq i \leqq 30$ and $10 \leqq j \leqq 40$, each in atomic %.

When the thin magnetic film 3 has a composition represented by the following formula: $Fe_k\ M_lN_m$, it is more preferred that the compounding ratios, k, l and m, satisfy the following relationships: $60 \leqq k \leqq 80$, $10 \leqq 1 \leqq 15$ and $5 \leqq m \leqq 30$.

The above-described insulation film 4 is composed of an insulation material such as $SiO_2$, $Al_2O_3$, $Si_3N_4$ or $Ta_2O_5$.

Among the materials constituting the thin magnetic film, Fe is a main component and is an element responsible for the magnetism. A greater content of Fe is preferred to obtain a high saturation magnetic flux density, however, Fe contents exceeding 70 atomic % in the Fe—M—O system or those exceeding 80 atomic % in the Fe—M—N system tends to decrease the specific resistance. Fe contents less than the above range, on the other hand, inevitably reduce the saturation magnetic flux density even though the specific resistance can be increased.

An element M selected from the group consisting of the rare earth elements, Ti, Zr, Hf, V, Nb, Ta and W is necessary for obtaining soft magnetic properties. These elements are apt to bond with oxygen or nitrogen and form an oxide or nitride by binding. Incidentally, further examples of the elements apt to bond with oxygen or nitrogen include Al, Si and B.

The specific resistance can be increased by adjusting the oxide or nitride content. The element M' is an element added to improve the corrosion resistance and to adjust the magneto striction. It is preferred to add these elements within the above-described range for such purposes.

Within the above composition range, a thin magnetic film having a specific resistance falling within a range of 400 to $2.0 \times 10^5$ $\mu\Omega$·cm can be obtained and by the heightening of the specific resistance, it is possible to reduce an eddy current loss, to suppress lowering in a high frequency magnetic permeability and to improve high frequency properties. In addition, particularly Hf is considered to have magneto-striction suppressing effects.

In the above constitution, the thin magnetic film 3 is preferably formed to a thickness of 0.5 $\mu$m or greater but 8 $\mu$m or smaller. Within this range, the figure of merit Q not lower than 1.5 can be obtained. If the film thickness is 1 $\mu$m or greater but 6 $\mu$m or smaller, the figure of merit Q not lower than 2 can be attained. In either case, a good figure of merit Q can be attained. Assuming that the thickness of the coil conductor 6 constituting the above-described coil pattern is "t" and its width is "a", it is preferred that the aspect ratio t/a of the coil conductor 6 satisfies the following relationship of $0.035 \leqq t/a \leqq 0.35$. By controlling the aspect ratio of the coil conductor to fall within the above-described range, the temperature rise of the coil conductor can be suppressed.

Assuming that the width of the coil conductor 6 constituting the above-described coil pattern is "a" and in the coil pattern, the distance between the mutually adjacent coil conductors 6,6 is "b", it is preferred that the ratio of the coil conductor, that is, a/(a+b) satisfies the following relationship: $0.2 \leqq a/(a+b)$. It is possible to obtain a stable inductance, a low equivalent resistance and a good figure of merit Q when the relationship of $0.2 \leqq a/(a+b)$ is satisfied.

For the fabrication of the thin magnetic element A having the above-described constitution, first a thin magnetic film 3 composed of a highly-resistant (high-ρ) A—M—M'—L base soft magnetic alloy is formed on one side of each of the substrates 1,2.

For that purpose, a thin film formation method such as sputtering or vapor deposition is basically employed.

Here, existing sputtering apparatuses such as RF double-pole sputtering, DC sputtering, magnetron sputtering, triple-pole sputtering, ion beam sputtering or target-opposed type sputtering can be employed for example.

In the next place, as a method to add O or N to the thin magnetic film, effectively usable is reactive sputtering in which sputtering is conducted in an $Ar+O_2$ or $Ar+N_2$ mixed gas atmosphere having an oxygen gas or nitrogen gas mixed in an inert gas such as Ar. It is also possible to prepare, in an inert gas such as Ar, a thin magnetic film by employing a composite target having Fe, an element M or an oxide or nitride thereof arranged on a target of Fe, FeM or FeM base alloy. Alternatively, it is possible to prepare, in an inert gas such as Ar, a thin magnetic film by employing, as a sputtering target, a composite target, which has, on a Fe target, a pellet composed of the rare earth element, Ti, Zr, Hf, V, Nb, Ta or W. The thin magnetic film of the above-described composition obtained by such a film formation method is formed mainly of an amorphous phase or formed of a crystalline phase and an amorphous phase existing as a mixture, before annealing treatment.

After a thin magnetic film having the desired composition is formed, it is subjected to the annealing treatment, more specifically, heating to 300 to 600° C. and then slow cooling, whereby a fine crystalline phase can be formed by precipitation in the thin magnetic film.

It is also possible to form a crystalline phase by subjecting the above-described thin soft magnetic film to the annealing treatment to cause partial precipitation and in this case, it is preferred to control the ratio of the crystalline phase to less than 50%. Ratios of the crystalline phase exceeding 50% lead to lowering in the magnetic permeability in the high frequency region. Here, the crystal grains precipitated in the texture have a grain size as fine as several nm to 30 nm and it is preferred that its average grain size is 10 nm or smaller. Precipitation of such fine crystal grains makes it possible to heighten the saturation magnetic flux density. The amorphous phase, on the other hand, is considered to contribute to an increase in the specific resistance so that owing to the existence of this amorphous phase, a specific resistance increases, leading to the prevention of a reduction in the magnetic permeability in the high frequency region.

On the above-described thin magnetic film 3, an insulation film 4 is formed in a manner known per se in the art such as film formation method, plating method or screen printing method, followed by the formation of a coil conductor 6 to obtain, for example, a spiral type coil 7 in a manner known per se in the art such as film formation method, plating method or screen printing method. Then the substrates 1,2 having the coil conductors 6 formed thereon are disposed on upper and lower sides of the substrate 5 so that the substrate 5 is interposed between the substrates 1,2, whereby a thin magnetic element A can be obtained.

In the case of a thin magnetic element A having the structures as shown in FIG. 1 and FIG. 2, either one of the coil conductors 6,6 can be used as a primary coil and the coil conductor on the other side can be used as a secondary coil, which enables the use of the thin magnetic element A as a transformer. In particular, by making effective use of the excellent properties of the thin magnetic film 3, as described above, at high frequency, the film can be applied to a small-sized, thin-type and highly-efficient transformer for DC-DC converter or reactor inductor which is driven at a switching frequency not lower than 1 MHz. When a thin magnetic film 3, an insulation film 4 and a coil 7 are formed on only one side of the substrate 5, the resulting thin magnetic element A can be used as an inductor.

In the conventional thin magnetic element, a large eddy current is generated around the coil, leading to a loss. If the above-described thin magnetic film 3 having a high specific resistance is employed, it is possible to provide a thin magnetic element A which is suppressed in the generation of an eddy current in a high frequency region and is therefore suppressed in a loss. In addition, since the loss of the thin magnetic element A can be controlled to be low, the thin magnetic element A and a transformer equipped therewith can be formed to be tolerable against a large electric power, resulting in the actualization of reductions in the thickness, size and weight.

Incidentally, the soft magnetic material constituting the thin magnetic film 3 and having the above-described composition has a sufficiently high specific resistance.

In Table 1, examples of the materials constituting the thin magnetic film 3 are shown. Each sample was prepared by carrying out sputtering in an atmosphere composed of Ar and 0.1 to 1.0% oxygen (O) using an RF magnetron sputtering apparatus and a composite target having a pellet of M or M' on a Fe target. Sputtering time was adjusted so that the film thickness would be about 2 μm. Sputtering conditions are as follows:

Preliminary gas exhaust: $1\times10^{-6}$ Torr or less

High-frequency electric power: 400 W

Ar gas pressure: 6 to $8\times10^{-3}$ Torr

Distance between electrodes: 72 mm

TABLE 1

| No. | Film composition | Bs(T) | Hc(Oe) | ρ (μΩ · cm) | μ eff (10 MHz) |
|---|---|---|---|---|---|
| 1 | $Fe_{54.9}Hf_{11.0}O_{34.1}$ | 1.2 | 0.8 | 803 | 2199 |
| 2 | $Fe_{51.5}Hf_{12.2}O_{36.3}$ | 1.1 | 1.2 | 1100 | 1130 |
| 3 | $Fe_{50.2}Hf_{13.7}O_{35.6}$ | 1.0 | 1.2 | 1767 | 147 |
| 4 | $Fe_{46.2}Hf_{18.2}O_{35.6}$ | 0.7 | 0.7 | 133709 | 100 |
| 5 | $Fe_{69.3}Zr_{6.5}O_{23.7}$ | 1.5 | 0.50 | 400 | 2050 |
| 6 | $Fe_{65.3}Zr_{8.9}O_{25.8}$ | 1.3 | 0.91 | 460 | 1030 |
| 7 | $Fe_{64.4}Nb_{12.2}O_{23.4}$ | 1.3 | 0.66 | 420 | 1600 |
| 8 | $Fe_{59.4}Ta_{15.3}O_{25.3}$ | 1.1 | 1.63 | 880 | 580 |
| 9 | $Fe_{51.5}Ti_{17.5}O_{31.0}$ | 1.1 | 1.38 | 750 | 420 |
| 10 | $Fe_{55.8}V_{13.2}O_{31.0}$ | 1.2 | 1.5 | 560 | 550 |
| 11 | $Fe_{58.7}W_{15.8}O_{25.5}$ | 1.2 | 2.25 | 670 | 400 |
| 12 | $Fe_{61.6}Y_{5.3}O_{33.1}$ | 1.4 | 1.31 | 420 | 780 |

TABLE 1-continued

| No. | Film composition | Bs(T) | Hc(Oe) | ρ (μΩ · cm) | μ eff (10 MHz) |
|---|---|---|---|---|---|
| 13 | $Fe_{63.2}Ce_{7.8}O_{29.0}$ | 1.1 | 1.88 | 580 | 640 |
| 14 | $Fe_{69.8}Sm_{11.0}O_{19.2}$ | 1.3 | 2.0 | 500 | 400 |
| 15 | $Fe_{68.5}Ho_{11.5}O_{20.0}$ | 1.1 | 1.2 | 800 | soa |
| 16 | $Fe_{64.2}Gd_{11.5}O_{24.3}$ | 1.2 | 3.4 | 840 | 350 |
| 17 | $Fe_{61.8}Tb_{10.8}O_{27.4}$ | 1.1 | 2.3 | 750 | 450 |
| 18 | $Fe_{62.5}Dy_{9.5}O_{28}$ | 1.1 | 4.0 | 680 | 530 |
| 19 | $Fe_{59.8}Er_{13.5}O_{26.7}$ | 1.0 | 3.7 | 580 | 380 |
| 20 | $Fe_{91.7}Hf_{4.1}O_{4.2}$ | | | 217.2 | |
| 21 | $Fe_{94.6}Hf_{2.0}O_{3.4}$ | | | 315.3 | |
| 22 | $Fe_{95.9}Hf_{1.0}O_{3.1}$ | | | 218.0 | |
| 23 | $Fe_{91.1}Hf_{2.1}O_{6.8}$ | | | 294.1 | |
| 24 | $Fe_{93.5}Hf_{1.0}O_{5.5}$ | | | 215.3 | |
| 25 | $Fe_{87.2}Hf_{3.5}O_{9.3}$ | | | 315.0 | |
| 26 | $Fe_{88.8}Hf_{2.1}O_{9.1}$ | | | 338.3 | |
| 27 | $Fe_{88.4}Hf_{2.1}O_{9.5}$ | | | 250.2 | |

As shown in Table 1, a thin magnetic film No. 4 having a composition of $Fe_{46.2}Hf_{18.2}O_{35.6}$ is able to have a specific resistance ρ of 133709 μΩ·cm, which is the specific resistance after annealing. Before annealing, a specific resistance as high as 194000 μΩ·cm can be attained. In addition, a specific resistance of about 215 to 1767 μΩ·cm can be attained easily in a FeHfO, FeZrO, FeNbO, FeTaO, FeTiO, FeVO, FeWO, FeYO, FeCeO, FeSmO, FeHoO, FeGdO, FeTbO, FeDyO or FeErO base composition by adjusting the compounding ratio of each component of the above composition.

Each of the samples shown in Tables 2 and 3 was obtained by preparing an alloy target composed of $Fe_{87}Hf_{13}$, adjusting the amount of nitrogen contained in an Ar gas, which was used as a carrier gas, to fall within a range of 5 to 80% and conducting high-frequency sputtering under the conditions of a gas pressure of 0.6 Pa and input voltage of 200 W. The compounding ratio of Fe and Hf was adjusted by an increase or decrease in the number of the chips of Hf. The soft magnetic alloy thin film so obtained was annealed at 400° C. for 3 hours in a magnetic field of 2 kOe. Then, a saturation magnetic flux density (Bs:T), coercive force (Hc:Oe), a ratio of the saturation magnetic field to anisotropic magnetic field (Hk:Oe) when a magnetic field was applied to the hard axis direction, a magnetic permeability (μ:10 MHz), a magneto striction (λs:×$10^{-6}$) and specific resistance (ρ:Ωcm) of the sample so obtained by annealing were measured. The results are shown in Tables 2 and 3.

TABLE 2

| Sample No. | | | Bs(T) | Hc(Oe) | Hk(Oe) |
|---|---|---|---|---|---|
| 1 | $Fe_{77.6}Hf_{12.6}N_{8.8}$ | As deposited | 6.2 | 1.68 | 3.52 |
| | | After annealing | 11.3 | 0.31 | 2.29 |
| 2 | $Fe_{71.5}Hf_{12.4}N_{16.1}$ | As deposited | 9.8 | — | — |
| | | After annealing | 11.9 | — | 4.24 |
| 3 | $Fe_{66.7}Hf_{11.8}N_{21.5}$ | As deposited | 6.5 | — | 0.8 |
| | | After annealing | 7.8 | 0.73 | 1.46 |
| 4 | $Fe_{74.3}Hf_{13.6}N_{12.1}$ | As deposited | 14.9 | 0.3 | 1.64 |
| | | After annealing | 15.0 | 0.4 | 2.64 |
| 5 | $Fe_{72.4}Hf_{12.3}N_{15.2}$ | As deposited | 13.8 | 0.43 | 2.04 |
| | | After annealing | 13.7 | 0.35 | 4.94 |
| 6 | $Fe_{69.1}Hf_{11.6}N_{19.1}$ | As deposited | 11.7 | 0.68 | 4.98 |
| | | After annealing | 11.6 | 0.78 | 6.70 |
| 7 | $Fe_{75.3}Hf_{14.7}N_{10}$ | As deposited | 3.8 | — | — |
| | | After annealing | 8.8 | 0.32 | 1.34 |
| 8 | $Fe_{64.8}Hf_{13.2}N_{22}$ | As deposited | 5.6 | 0.63 | 1.94 |
| | | After annealing | 6.8 | 0.37 | 2.32 |
| 9 | $Fe_{69.2}Hf_{13.9}N_{16.9}$ | As deposited | 9.0 | 0.21 | 0.66 |

TABLE 2-continued

| Sample No. | | | Bs(T) | Hc(Oe) | Hk(Oe) |
|---|---|---|---|---|---|
| | | After annealing | 11.0 | 0.55 | 5.58 |
| 10 | $Fe_{67}Hf_{14}N_{19}$ | As deposited | 11.8 | 0.70 | 3.44 |
| | | After annealing | 11.7 | 0.66 | 5.68 |
| 11 | $Fe_{64.6}Hf_{14.1}N_{21.1}$ | As deposited | 5.2 | 0.31 | 0.58 |
| | | After annealing | 6.5 | 0.38 | 1.8 |
| 12 | $Fe_{61.5}Hf_{13.4}N_{25.1}$ | As deposited | 0.27 | — | — |
| | | After annealing | — | — | — |

TABLE 3

| Sample No. | | μ (10 MHz) | λ s(× $10^{-6}$) | ρ (μ Ωcm) |
|---|---|---|---|---|
| 1 | As deposited | 38 | 0.93 | 193.6 |
| | After annealing | 2518 | 2.25 | 150.8 |
| 2 | As deposited | 252 | 6.97 | 278.6 |
| | After annealing | 1174 | 8.62 | 251.9 |
| 3 | As deposited | 253 | 4.06 | 312.7 |
| | After annealing | 1274 | 5.55 | 343.7 |
| 4 | As deposited | 1192 | 3.76 | 140.9 |
| | After annealing | 4128 | 3.57 | 132.5 |
| 5 | As deposited | 750 | 6.86 | 192.8 |
| | Afteranne1ing | 2114 | 7.00 | 186.5 |
| 6 | As deposited | 734 | 10.02 | 293.3 |
| | After annealing | 1152 | 9.47 | 267.9 |
| 7 | As deposited | 6.70 | −0.06 | 235.0 |
| | After annealing | 948 | 1.36 | 184.4 |
| 8 | As deposited | 352 | 7.83 | 263.3 |
| | After annealing | 1608 | 4.23 | 376.2 |
| 9 | As deposited | 128 | 2.44 | 453.6 |
| | After annealing | 1522 | 7.77 | 291.4 |
| 10 | As deposited | 343 | 8.83 | 292.0 |
| | After annealing | 1139 | 9.72 | 286.3 |
| 11 | As deposited | 146 | 3.33 | 359.5 |
| | After annealing | 2067 | 3.81 | 385.8 |
| 12 | As deposited | — | — | 422.4 |
| | After annealing | — | — | 376.9 |

Each sample shown in Tables 1 and 2 exhibited an excellent saturation magnetic flux-density, coercive force, magnetic permeability and magneto striction and exhibited a specific resistance as high as about 200 to 400 Ωcm. Incidentally, when the value of the anisotropic magnetic field is small, the magnetic permeability at a low frequency region increases but tends to show a marked decrease in the high frequency region, while when the value of the anisotropic magnetic field is large, the magnetic permeability not so large in the low frequency region can be maintained even in the high frequency region, which suggests an excellent magnetic permeability in a high frequency region.

In the FeMO base thin magnetic film, as disclosed in Table 1, a saturation magnetic flux density of 1.0 to 1.5 T (10 to 15 kG) can be attained, while in the FeMN base thin magnetic film, that exceeding 1 T (10 kG) can easily be attained. In either of the films, it is possible to attain a saturation magnetic flux density of 10 kG or higher by far higher than that, 5 kG, of the ferrite or the like.

EXAMPLES

A thin magnetic element sample was fabricated by forming thin magnetic films each having the composition of $Fe_{55}Hf_{11}O_{34}$ and a thickness of 3 μm on two 12 cm×12 cm quadrate substrates made of a high polymer film or ceramic; forming, on the thin magnetic films, square spiral coils made of copper as illustrated in FIG. 2 through 17-μm thick insulation films composed of $SiO_2$ (or high polymer).; and then, as illustrated in FIG. 1, disposing the resulting substrates, as illustrated in FIG. 1, on both sides of an insulation layer formed of $SiO_2$ or a high polymer, respectively. The spiral coil employed had an overall width D of 10 mm and 9 turns.

Figure 3:
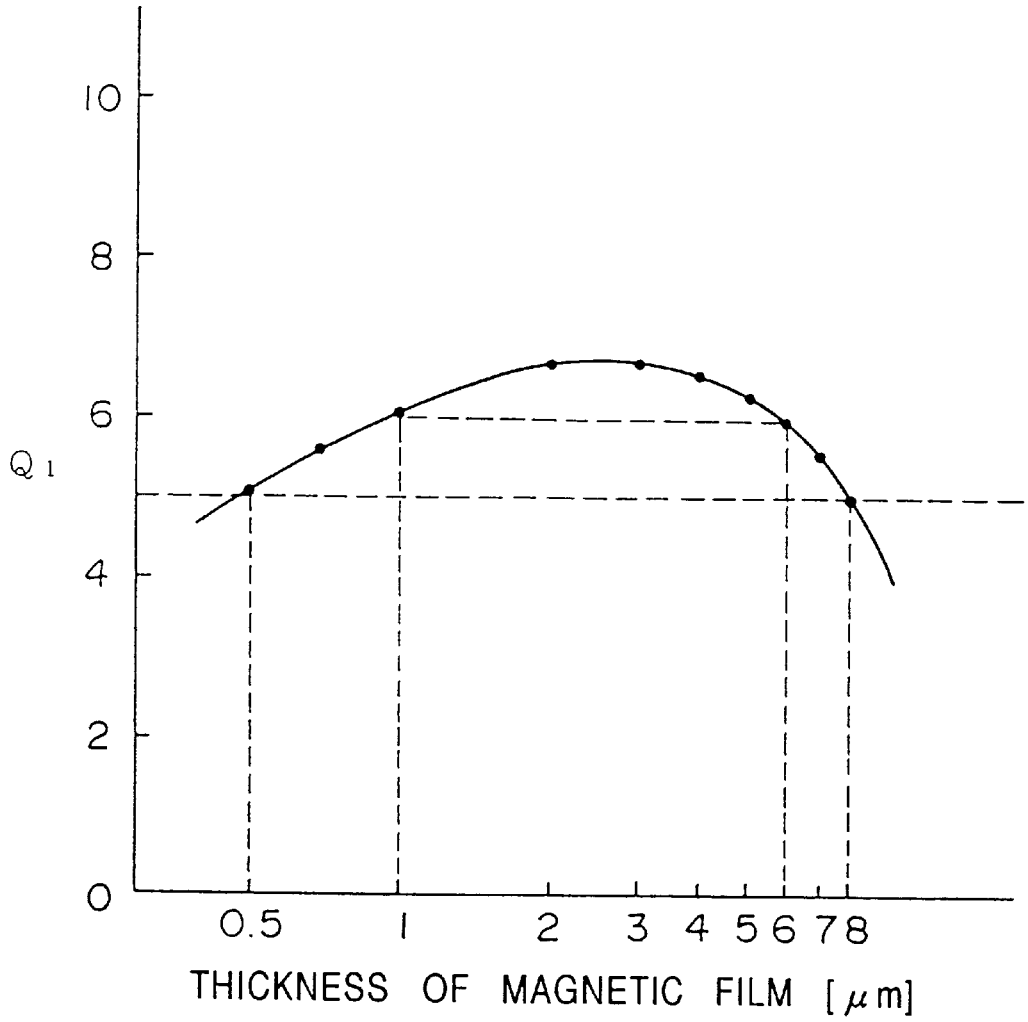
FIG. 3 is a graph showing a dependence, on the thickness of the magnetic layer, of the upstream figure of merit of a thin magnetic element sample.

FIG. 3 shows the measuring results of the dependence of the coil conductor thickness on the upstream figure of merit Q at the frequency of 10 MHz when the width of the coil conductor is 0.4 mm, the distance between coil conductors is 0.5 mm and the thickness of the coil conductor is t. As is apparent from the results shown in FIG. 3, when the thickness of the magnetic layer falls within a range of 0.5 μm or greater but 8 μm or smaller, the upstream figure of merit Q not smaller than 1.5 can be attained and moreover, when the thickness of the magnetic layer falls within a range of 1 μm or greater but 6 μm or smaller, the upstream figure of merit Q not smaller than 2 can be attained.

Figure 4:
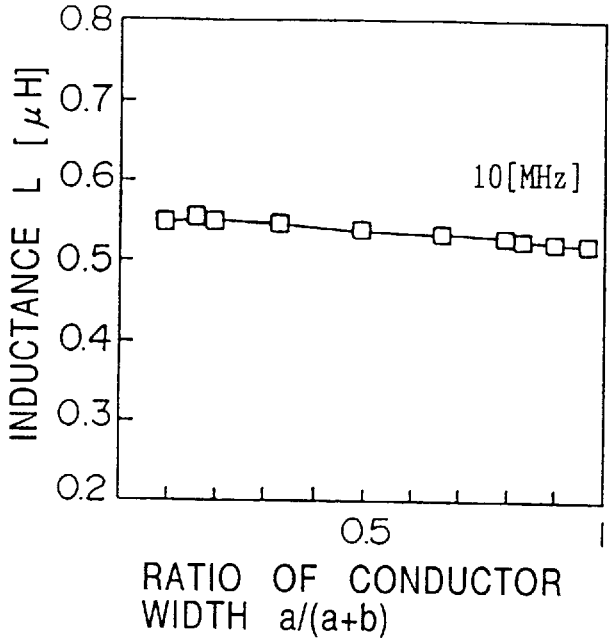
FIG. 4 is a graph showing the relationship between an inductance and a conductor width of the thin magnetic element sample.
Figure 5:
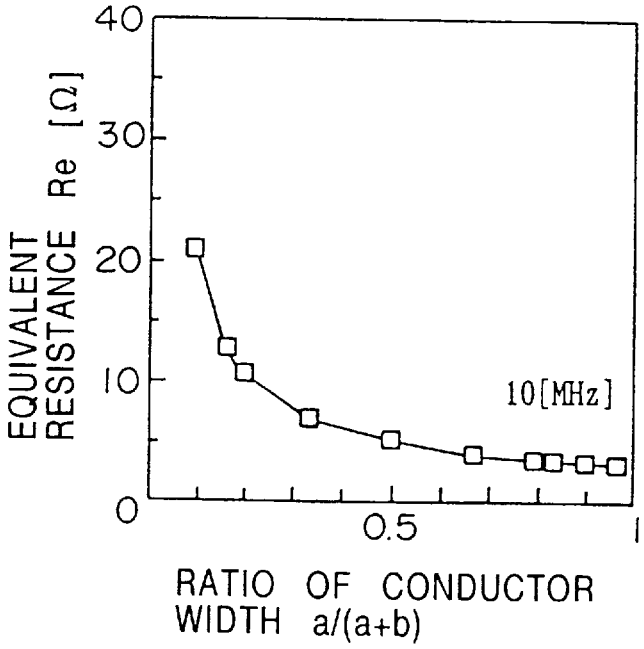
FIG. 5 is a graph showing the relationship between an equivalent resistance and a conductor width of the thin magnetic element sample.
Figure 6:
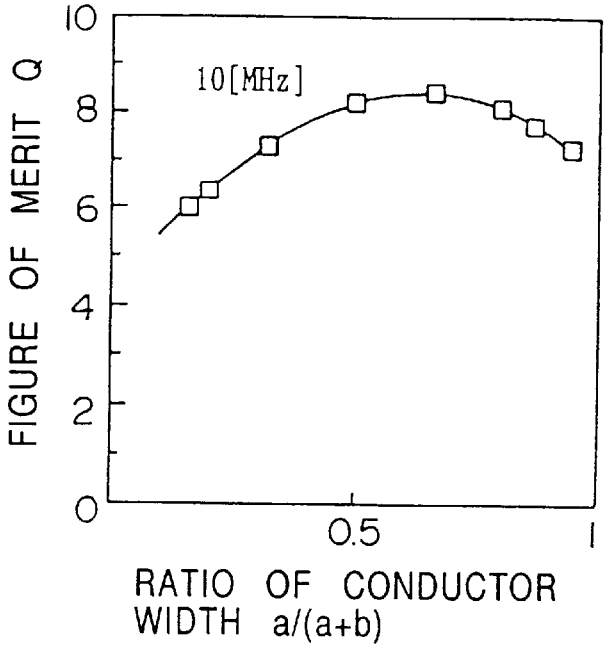
FIG. 6 is a graph showing the relationship between a figure of merit Q and a conductor width of the thin magnetic element sample.

FIG. 4 illustrates the variations of the inductance measured at 10 MHZ as a function of the ratio of the coil conductor width represented by the formula a/(a+b), when the magnetic layer thickness is adjusted to 3 μm and the distance between the adjacent coil conductors 6,6 is designated as b. FIG. 5 illustrates the results of the variations of an equivalent resistance measured at 10 MHz as a function of a ratio of a coil conductor width, which is represented by a/(a+b), of a thin magnetic element having the similar composition. FIG. 6 illustrates the variations of the figure of merit Q as measured at 10 MHz as a function of the ratio of the coil conductor width.

From the results shown in FIGS. 4, 5 and 6, it can be understood that when the ratio of the coil conductor width is at least 0.2, the equivalent resistance shows a drastic reduction and becomes a good value and besides, a high figure of merit Q can be obtained. In FIG. 4, the inductance showed a little lowering tendency with a rise in the coil conductor width, which is presumed to be caused by the disturbance of the magnetic flux by the coil conductor. In FIG. 5, the equivalent resistance shows an increase when the coil conductor width is narrow, which owes to the small cross-sectional area of the coil conductor itself. The wider the coil conductor width, the higher the value of Q, which results from the properties of the equivalent resistance. It is apparent that the figure of merit is within a preferred range when the ratio of the coil conductor width is at least one 0.2.

Figure 7:
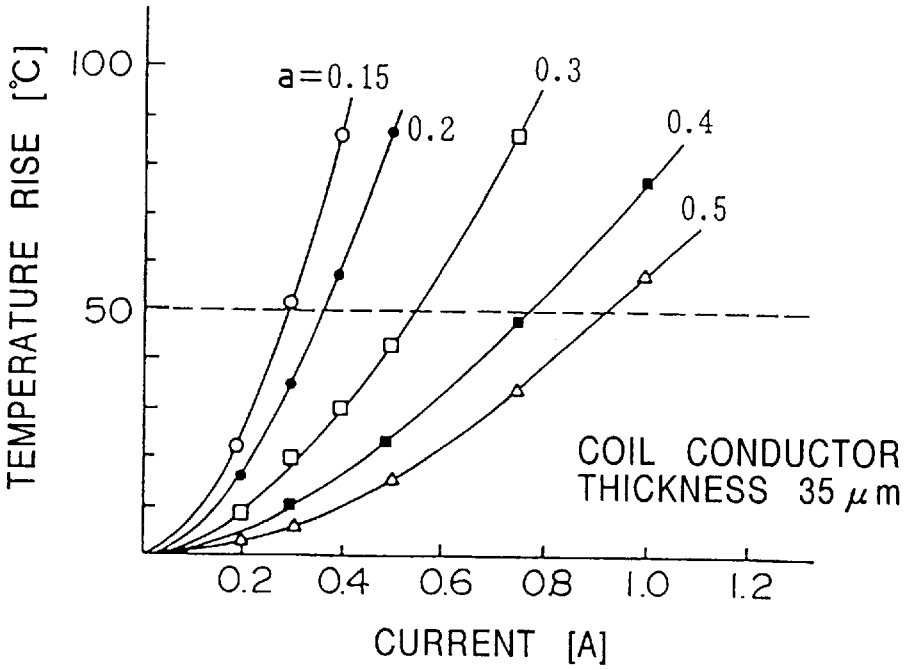
FIG. 7 is a graph showing the relationship between a current and a temperature rise of the thin magnetic element sample in the case where the coil conductor width is 35 $\mu$m.
Figure 8:
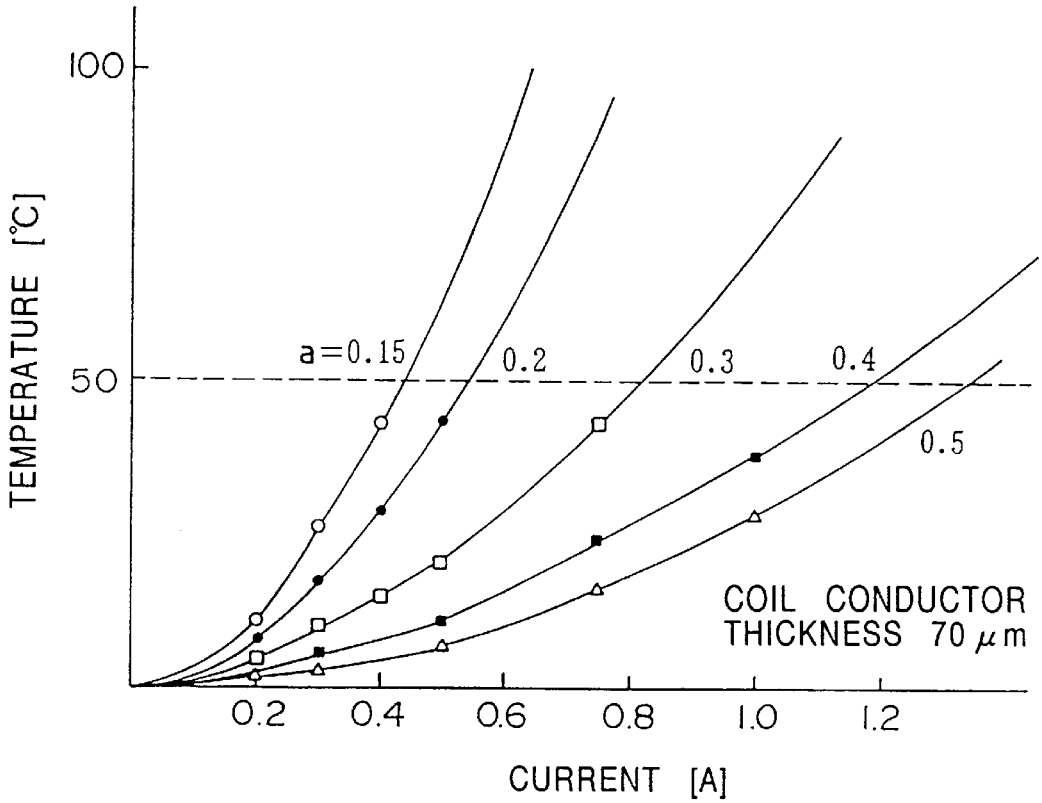
FIG. 8 is a graph showing the relationship between a current and a temperature rise of the thin magnetic element sample in the case where the coil conductor width is 70 $\mu$m.

FIG. 7 shows the results of a temperature rise, as measured by a thermocouple, which appeared at the time of the energization test conducted on a plural number of coil samples which were formed on a polyimide film of 25 μm thick to have a spiral shape as illustrated in FIG. 2 and have a copper-made coil conductor having a thickness of 35 μm and width of 0.15 mm, 0.2 mm, 0.3 mm, 0.4 mm and 0.5 mm, respectively. FIG. 8 shows the results of the similar test when the copper-made coil conductor had a thickness of 70 μm.

When the temperature does not exceed 50° C. in the results shown in FIGS. 7 and 8, the resulting coil conductor can be provided for a practical use and the current to be applied within a range of about 0.5 to 1.0A is practical.

In consideration of the above results, it is possible to select a coil conductor width a from a range of 0.3 mm to 1.0 mm in the case of the copper-made conductor coil having a thickness of 35 μm, while it is possible to select a coil conductor width a from a range of 0.2 mm to 1.00 mm in the case of the copper-made conductor coil having a thickness of 70 μm. Accordingly, it can be understood that the aspect ratio indicated by t/a preferably falls within a range of 0.035 to 0.12 in the case of the copper-made conductor coil of 35 μm thick and a range of 0.07 to 0.35 in the case of the conductor coil of 70 μm thick. In either case, generation of heat can be suppressed if the aspect ratio falls within a range of 0.035 to 0.35, more preferably with in a range of 0.07 to 0.12. Incidentally, the coil conductor width exceeding 1.0 mm tends to cause short-cut of the adjacent conductor coil, which disturbs the size reduction of the element. The coil conductor width a is therefore adjusted to be 1.0 mm or smaller. Also in the case of a meander type conductor coil, it is preferred to adjust the coil conductor width to 1.0 mm or smaller, because magnetic fluxes of the adjacent conductor coils, which fluxes are opposite to each other, interfere each other.

What is claimed is:

1. A thin film magnetic element comprising a coil pattern formed on at least one side of a substrate, and a thin magnetic film formed on the coil pattern, wherein:

assuming that the thickness and width of a coil conductor constituting the coil pattern are "t" and "a", respectively, the aspect ratio t/a of the coil conductor satisfies the relationship $0.035 \leqq t/a \leqq 0.35$, and the thin magnetic film has a resistivity of 400 μΩcm or more.

2. A thin film magnetic element according to claim 1, wherein assuming that the width of the coil conductor constituting the coil pattern is "a", and the distance between the coil conductors adjacent each other in the coil pattern is "b", the relationship of $0.2 \leqq a/(a+b)$ is satisfied.

3. A transformer comprising coil patterns formed on both sides of a substrate, and thin magnetic films formed on the coil patterns, wherein:

assuming that the thickness and width of a coil conductor constituting the coil patterns are "t" and "a", respectively, the aspect ratio t/a of the coil conductor satisfies the relationship $0.035 \leqq t/a \leqq 0.35$, and the thin magnetic films have a resistivity of 400 μΩcm or more.

4. A transformed according to claim 3, wherein assuming that the width of the coil conductor constituting the coil patterns is "a", and the distance between the coil conductors adjacent each other in the coil pattern is "b", the relationship of $0.2 \leqq a/(a+b)$ is satisfied.

* * * * *

UNITED STATES PATENT AND TRADEMARK OFFICE

CERTIFICATE OF CORRECTION

PATENT NO. : 6,351,204 B1
DATED : February 26, 2002
INVENTOR(S) : Kiyohito Yamasawa et al.

It is certified that error appears in the above-identified patent and that said Letters Patent is hereby corrected as shown below:

Column 10,
Line 50, delete “transformed” and substitute -- transformer -- in its place.

Signed and Sealed this

Eighth Day of October, 2002

*Attest:*

*Attesting Officer*

JAMES E. ROGAN
*Director of the United States Patent and Trademark Office*